US005905694A

United States Patent [19]

Rothberg

[11] Patent Number: 5,905,694

[45] Date of Patent: May 18, 1999

[54] COORDINATED PRESENTATION APPARATUS AND METHOD

[76] Inventor: Michael R. Rothberg, 6392 S. Geneva Cir., Englewood, Colo. 80111

[21] Appl. No.: 08/688,407

[22] Filed: Jul. 30, 1996

Related U.S. Application Data

[60] Provisional application No. 60/001,788, Aug. 2, 1995.

[51] Int. Cl.[6] ..... G04F 8/00

[52] U.S. Cl. ..... 368/113; 368/107

[58] Field of Search ..... 368/10, 47–54, 368/243, 244, 107

[56] References Cited

U.S. PATENT DOCUMENTS

| | | | |
|---|---|---|---|
| 4,316,273 | 2/1982 | Jetter | 368/47 |
| 4,755,792 | 7/1988 | Pezzolo et al. | 368/10 |
| 5,361,397 | 11/1994 | Wright | 368/10 |
| 5,475,380 | 12/1995 | Shim | 368/10 |
| 5,499,020 | 3/1996 | Motohashi et al. | 368/10 |
| 5,623,242 | 4/1997 | Dawson, Jr. et al. | 368/10 |

OTHER PUBLICATIONS

Catalog Cut Sheet "PaceSetter Keeps Speeches and Presentations on Track, so You Don't Lose Your Audience, and Do Make YOur Point," Date Unknown (before May 16, 1995).

*Primary Examiner*—Bernard Roskoski
*Attorney, Agent, or Firm*—Bruce R. Winsor

[57] ABSTRACT

A timing device for coordinating a presentation includes a master timer with a timing initiator, a programmable master sequencer responsive to the timing initiator, a master sensory alarm responsive to the sequencer, a master alarm silencer, and a communication transmitter responsive to at least one of the timing initiator and the master sequencer. The timing initiator begins operation of the master sequencer. The master sequencer actuates the master sensory alarm at at least one predetermined time after initiation. The communication transmitter sends a signal when the timing initiator beginning operation of the master sequencer or at a predetermined time after initiation of operation of the master sequencer. At least one slave timer, and optionally a plurality of slave timers, is provided. Each slave timer includes a communication receiver responsive to the communication transmitter of the master timer, a slave sensory alarm operatively responsive to the communication receiver, and a slave sensory alarm silencer. The communication receiver receives the signal from the communication transmitter and responds,by operatively activating the slave sensory alarm at the time the signal is received or at a predetermined time after the signal is received.

18 Claims, 5 Drawing Sheets

COORDINATED PRESENTATION APPARATUS AND METHOD

RELATED APPLICATIONS

This application is a continuation of co-pending U.S. Provisional Patent Application Ser. No. 60/001,788 filed Aug. 2, 1995.

FIELD OF THE INVENTION

This invention relates to timing devices for oral presentations. More particularly the invention relates to a timing device to coordinate the presentations of multiple speakers.

BACKGROUND

In many professions there is the need to make oral presentations within defined time limits. For example, an attorney is often required to present an opening argument or a closing argument, or other type of argument, wherein a specific amount of time is allotted for the argument. Another example might be a scientist, engineer or other professional who is presenting a paper to an audience within a specific time frame. A third example is a formal interview presentation given by an individual or group of individuals, wherein information is presented in a formal setting to a body that will be selecting a firm or individuals to perform work.

In each of these situations time constraints may be critical, if not mandatory. Further, it is often desirable to divide a presentation into segments, such as an opening, body, and closing, to provide for a question and answer period, to reserve time for future use, or to divide the presentation time among a plurality of presenters.

Typically, in these presentation settings, the individual or individuals making a presentation are preoccupied with the specific information included in the presentation and can easily loose track of time. In presentations involving several presenters, one presenter exceeding the time limits can greatly affect the portions to be presented by the other presenters, and the quality of the overall presentation.

Prior art timing devices are typically involve a distracting and disruptive audible or visual alarm, or are limited to a single alarm point. Further, prior art timing devices typically require imprecise manual synchronization if they are to used by multiple presenters.

SUMMARY OF THE INVENTION

One significant aspect of the present invention is a timing device for coordinating a presentation. The timing device includes a master timer with a timing initiator, a programmable master sequencer responsive to the timing initiator, a master sensory alarm responsive to the sequencer, a master alarm silencer, and a communication transmitter responsive to at least one of the timing initiator and the master sequencer. The timing initiator begins operation of the master sequencer. The master sequencer actuates the master sensory alarm at at least one predetermined time after initiation. The communication transmitter sends a signal when the timing initiator begins operation of the master sequencer or at a predetermined time after initiation of operation of the master sequencer. The master sensory alarm is stopped by activation of the master sensory alarm silencer. At least one slave timer, and optionally a plurality of slave timers, is provided. Each slave timer includes a communication receiver responsive to the communication transmitter of the master timer, a slave sensory alarm operatively responsive to the communication receiver, and a slave sensory alarm silencer. The communication receiver receives the signal from the communication transmitter and responds by operatively activating the slave sensory alarm at the time the signal is received or at a predetermined time after the signal is received. The slave sensory alarm is stopped by activation of the slave sensory alarm silencer.

Further in accordance with this aspect of the invention the slave timer may further include a slave sequencer responsive to the communication receiver. The communication receiver responds to the signal from the communication transmitter to initiate operation of the slave sequencer. The slave sequencer actuates the slave sensory alarm at at least one predetermined time after initiation.

Still further in accordance with this aspect of the invention the communication receiver may respond to the signal from the communication transmitter to directly activate the slave sensory alarm.

Where a plurality of slave timers are provided the communication transmitter responds to the master sequencer to transmit at least a first and a second unique signals. At least one of the plurality of slave timers is responsive to the first unique signal and unresponsive to the second unique signal. At least another one of the plurality of slave timers is responsive to the second unique signal and unresponsive to the first unique signal.

Further in accordance with this aspect of the invention a slave timer may include a slave sequencer responsive to the communication receiver. The communication receiver responds to a signal from the communication transmitter to initiate operation of the slave sequencer. The slave sequencer actuates the slave sensory alarm at at least one predetermined time after initiation.

Still further in accordance with this aspect of the invention the communication receiver of each slave receiver may respond to one of the at least a first and a second unique signal from the communication transmitter to directly activate the slave sensory alarm.

Each signal transmitted by the communication transmitter may be a low power radio signal. The at least a first and a second unique signals may have unique transmission frequencies or may have unique digital patterns.

The timing initiation may manually activated. Either or both of the master sensory alarm silencer and the slave sensory alarm silencer may also be manually activated. Alternatively, either or both of the master sensory alarm silencer and the slave sensory alarm silencer may be automatically activated by the passage of a predetermined period of time. Either or both of the master sensory alarm and the slave sensory alarm may be vibratory alarms. Either or both of the master timer and the slave timer may be wearable.

Yet further in accordance with this aspect of the invention, the master sensory alarm may be remotely located from the master sequencer and communication transmitter. A master communication receiver is responsive to the communication transmitter, and the master sensory alarm is operatively responsive to the communication receiver.

Another significant aspect of the present invention is timing device for coordinating a presentation that includes a wearable master timer and at least one wearable slave timer, and optionally a plurality of wearable slave timers. The wearable master timer includes a timing initiation push button, a programmable master sequencer connected to respond to the timing push button to begin a programmed timing sequence, a master vibratory alarm connected to cause the master timer to vibrate silently at at least one programmed time after the beginning of the programmed timing sequence, a master alarm silencing push button connected to turn off the master vibratory alarm, and a low power radio transmitter connected to send at least one radio signal at at least one of the beginning of the programmed timing sequence and a programmed time after the beginning of the timing sequence. Each wearable slave timer includes a low power radio receiver responsive to the low power radio transmitter of the master timer, a slave vibratory alarm connected to vibrate the slave timer silently at least in part in response to the receipt of the radio signal at at least one programmed time after the beginning of the timing sequence, and a slave alarm silencing push button connected to turn off the slave vibratory alarm.

Further in accordance with this aspect of the invention, where a plurality of slave timers are provided the low power radio transmitter transmits at least a first and a second unique signals. At least one of the plurality of slave timers is responsive to the first unique signal and unresponsive to the second unique signal. At least another one of the plurality of slave timers is responsive to the second unique signal and unresponsive to the first unique signal.

Yet another significant aspect of the present invention is a method for coordinating a presentation. In accordance with this aspect of the invention a master timer is provided to a first presenter. A slave timer is provided to a second presenter. An additional slave timer may be provided to the first presenter and further additional slave timers may be provided to further presenters. A timing sequence is initiated. A sensory alarm is given to the first presenter at at least one predetermined time after initiating the timing sequence. At least one signal is communicated from the master timer to the slave timer. A sensory alarm is provided to the second presenter at at least one predetermined time after initiation of the timing sequence. The method and apparatus for coordinating a presentation of the present invention accurately coordinates a presentation given by a plurality of presenters without the need for distracting audible or visual signals. Further, the present invention provides the ability to coordinate the segments of each presenters portion of the presentation.

Further aspects and advantages of the present invention will be apparent to those skilled in the art from the drawings, detailed description of the preferred embodiment and claims that follow.

DETAILED DESCRIPTION OF THE PREFERRED EMBODIMENT

A presently preferred embodiment of the present invention will be described by reference to FIGS. 1 through 6. Like numerals denote like elements of the embodiment.

Figure 2:
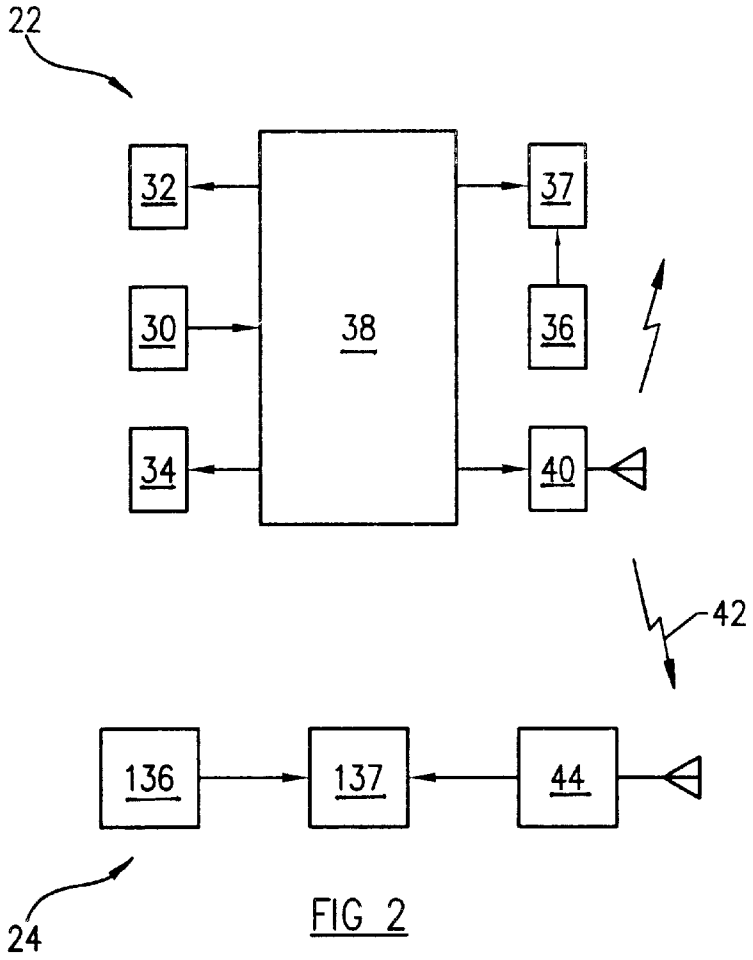
FIG. 2 is a block diagram of the embodiment of a timing device shown in FIG. 1.
Figure 1:
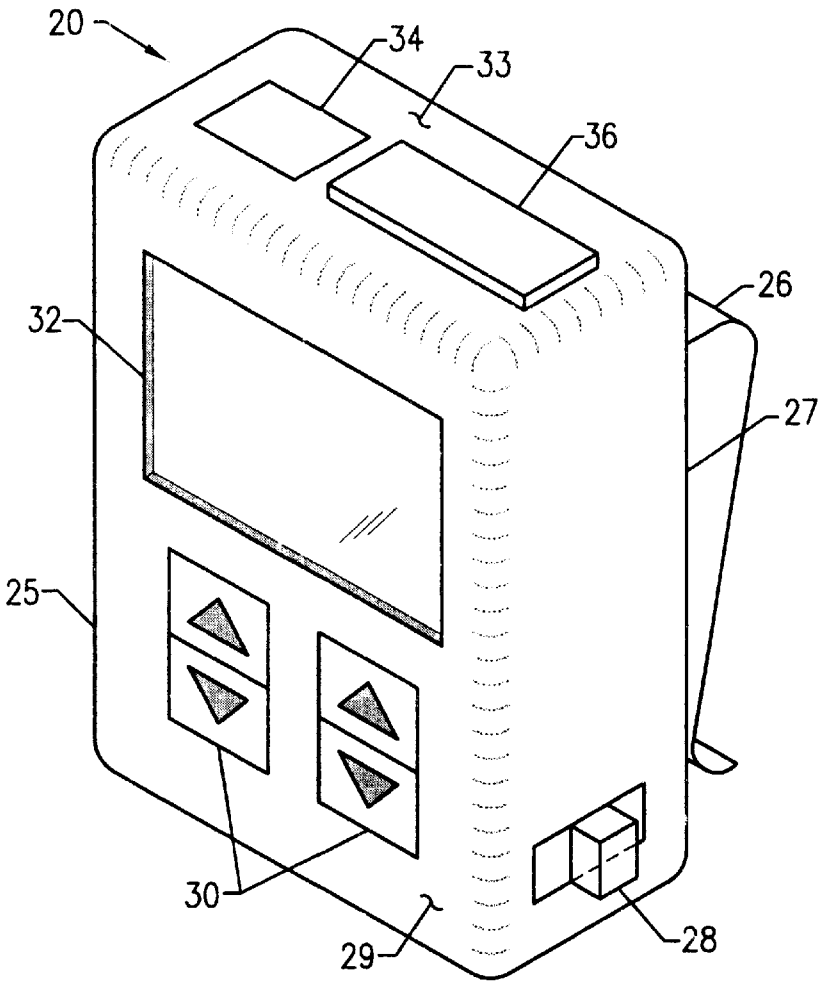
FIG. 1 is a perspective view of an embodiment of a timing device for coordination a presentation in accordance with the present invention.

FIG. 1 illustrates a wearable timing module 20 or timer of a preferred embodiment of a timing device of the present invention. The wearable timing module 20 may be either a master timer 22 (FIG. 2) or a slave timer 24 (FIG. 2). A master timer 22 is illustrated. A slave timer 24 may be similar, with certain unnecessary elements omitted. The wearable timing module 20 comprises a housing 25, approximately the size of a typical pager, having a belt clip 26 attached to a back side 27 of the housing 25. The belt clip 26 provides a means for attaching the timing module to a presenter. The timing module 20 is provided with an power switch 28 which may be a well-known slide switch, as illustrated, a pair of membrane push-button switches, a single toggling membrane push-button switch or any one of several well known types of switches. The front 29 of the module 20 is provided with programming input devices 30 and a programming input display 32. The programming input devices 30 may be any of several well-known types, such as membrane momentary push-buttons as illustrated. The programming input devices 30 may devices for selecting modes or timer actuation points to be programmed and switches to increment or decrement a program value. The display 32 may be a liquid crystal display, a light emitting diode display, or any display having a low power requirement, small size and adequate flexibility of use and visibility.

The top 33 of the timing module 20 has a timing initiator in the form of an initiation switch 34 to begin a timing sequence and a sensory alarm silencer in the form of a silence switch 36 to turn off a sensory alarm 37 (FIG. 2) once the alarm has been activated by the module 20. The initiation switch 34 and silence switch 36 may be any of several well known types. The silence switch may extend above the top 33 of the module 20 to facilitate locating 36 by feel to turn off the sensory alarm 37.

FIG. 2 illustrates the functionality of the preferred embodiment of the present invention. Each timing module 20 (FIG. 1) is battery (not shown) powered and is provided with an externally operable power switch 28 (FIG. 1) to turn the timing module 20 on and off. Timing module may utilize single use batteries or may use rechargeable batteries and have a connector (not shown) for battery charging.

The master timer 22 comprises a programmable multipoint timing unit 38 which may consist of a microcomputer with a time reference generating unit, such as a crystal, and memory all of which are well known. Once power is applied to the master timer 22 by its power switch 28 the programming input devices 30 and programming input display 32 comprise means to establish time actuation points in the memory of the timing unit 38 and for identifying the time actuation points as actuating the sensory alarm device 37 of the master timer 22 or a sensory alarm device 137 of a selected slave timer 24. Once the actuation points are programmed the initiation switch 34 may be pressed, as at the beginning of a presentation to be coordinated, thereby beginning the programmed timing sequence. The program input devices 30, program input display 32 and master timing unit 38 comprise, in combination, a programmable master sequencer. At each actuation point the timing unit 38 will activate either the master timer sensory alarm 37 or will cause a communications transmitter, such as a low power radio transmitter 40, of a well known type, to send a radio signal 42 to a communications receiver, such as a radio receiver 44, also well known, of a slave timer 24. The radio signal 42 may be uniquely coded to actuate only a particular one of a plurality of radio receivers 44, as by a digital code or by frequency selection.

If the master timing unit 38 actuates the master sensory alarm 37, which may be a silent vibratory alarm or a low volume auditory alarm, the alarm will signal the presenter wearing the master timer 22 until the presenter manually activates the silence switch 36. Alternatively, the silence switch may be omitted and the master sensory alarm 37 activated for a predetermined period of time and automatically turned off at the end of the predetermined time period.

Of course, the radio transmitter 40 may be unused, or may be omitted entirely from the master timing module 20, in which case the timing unit 20 will function as a stand-alone timer for a single presenter.

If the master timing unit 38 actuates the radio transmitter 40, thereby activating the radio receiver 44 of a slave timer 24, the slave sensory alarm 137, which may be a silent vibratory alarm or a low volume audible alarm, will be activated until the presenter wearing the activated slave timer 24 manually activates a silence switch 136 of the slave timer 24. Alternatively, the slave sensory alarm 137 may be activated for a predetermined period of time. Of course, the master sensory alarm 37 and slave sensory alarm 137 may also be activated simultaneously, if desirable for presentation coordination.

There are many possible programming variations of the sensory alarm sequences that are possible including multiple alarms for each presenter, each presenter receiving only alarms for his own portion of the presentation, each presenter receiving all alarms, differing alarm patterns. All these variations are within the ordinary skill of one skilled in the art.

Figure 3:
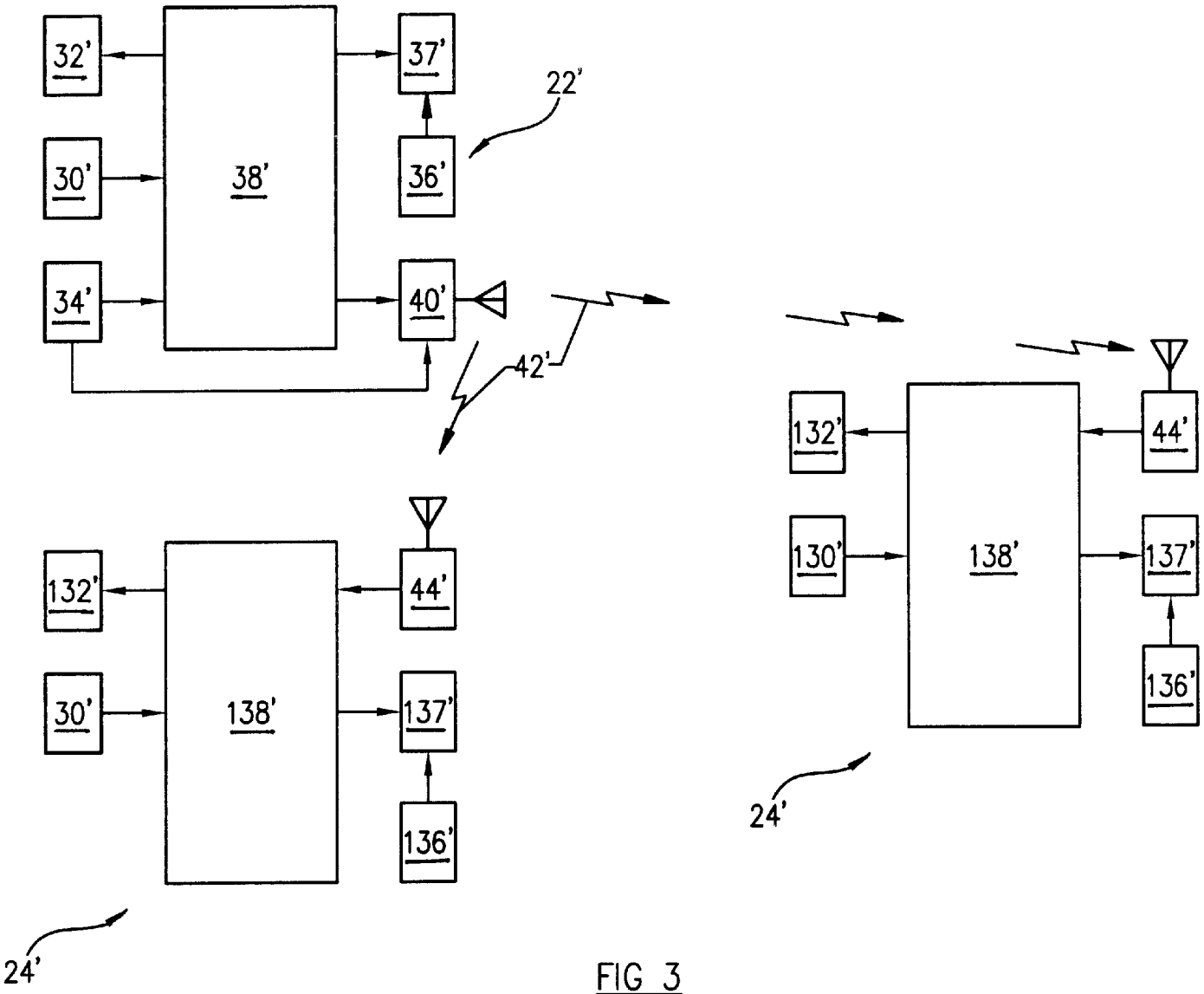
FIG. 3 is a block diagram of an alternative embodiment of the timing device shown in FIG. 1.

FIG. 3 illustrates a functional variation of the preferred embodiment of the present invention. Each slave timer 24' may be provided with a slave sequencer in the form of a programmable multi-point timing unit 138' similar to the timing unit 38' of the master timer 22'. Each slave timer 24' would then be programmable by use of programming input devices 130' and a programming display 132' in a manner similar to the programming of the master timer 22'. In this case, when the initiation switch 34' of the master timer 22' is activated it starts the program of the master timing unit 38' and activates the radio transmitter 40', which in turn activates the radio receivers 44' of the slave timers 24'. The radio receivers 44' initiate programmed timing sequences of the slave timing units 138' of the slave timers 24'. Alternatively, the radio transmitter 40' of the master timer 22' may be activated at one or more programmed slave timer initiation times, which in turn may initiate the programmed timing sequences of the slave timing units 138'. In either case, the master sensory alarm 37' is activated by programmed actuation points of the master timing unit 38' and each slave sensory alarm is activated by programmed actuation points of its corresponding slave timing unit 138'.

In yet another functional variation, not illustrated, the communication receiver 44' of a slave timer 24' may comprise a combination transmitter and receiver or transceiver. In this embodiment a first slave timer 24' has the sequence of its slave timing unit 138' initiated by a signal 42' from the transmitter 40' of the master timer 22'. A second slave timer has the sequence of its timing unit initiated by a signal of the transceiver of the first slave timer and so on in daisy chain fashion.

Figure 4:
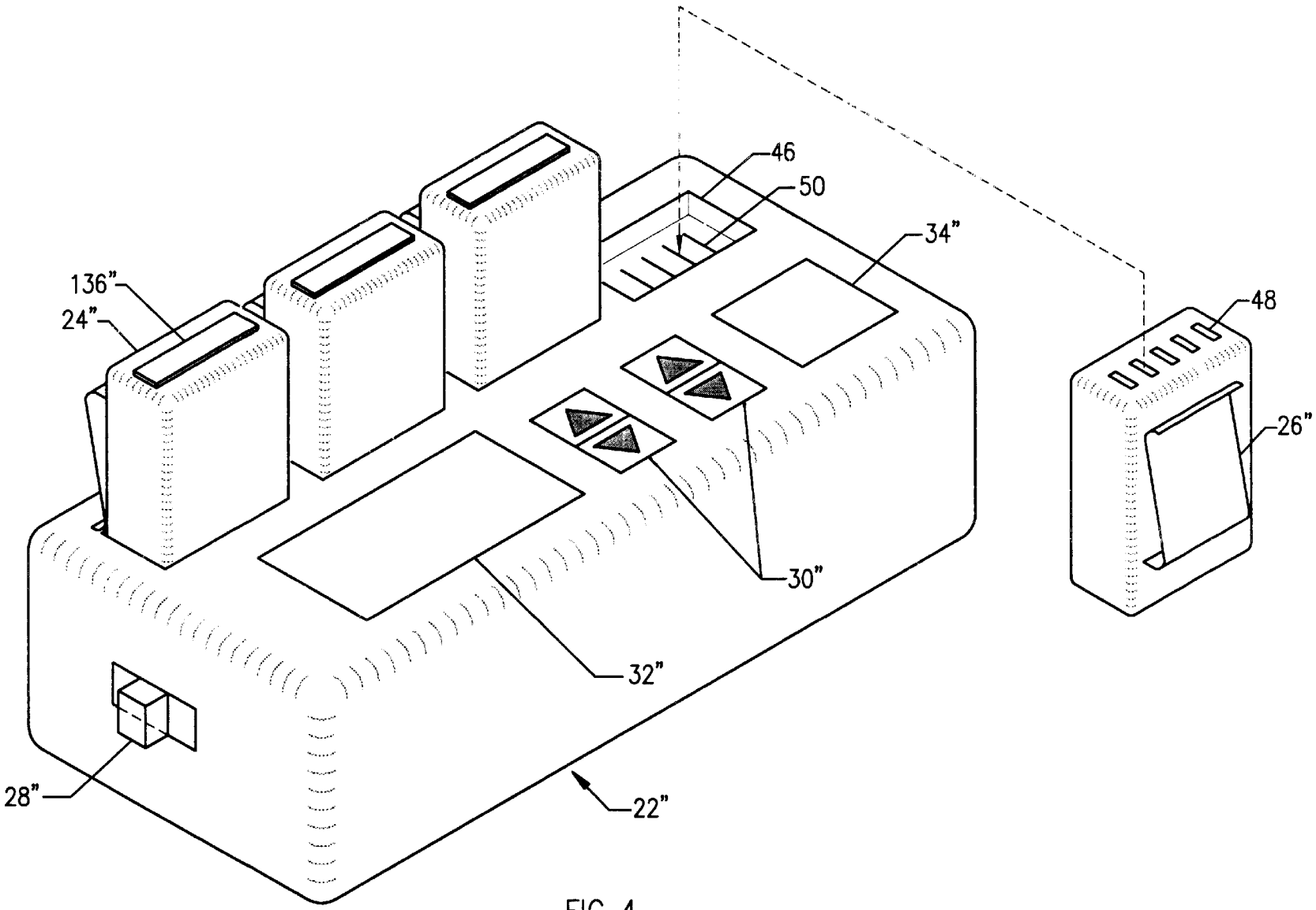
FIG. 4 is a perspective view of a further embodiment of a timing device for coordinating a presentation in accordance with the present invention.

FIG. 4 illustrates an alternative preferred embodiment of the present invention. In the alternative preferred embodiment the master timing unit 22" has a power switch 28", programming input devices 30", a programming input display 32" and a timing initiation switch 34". The plurality of receptacles 46 are provided, one for each slave timer 24". Each slave timer 24" has a plurality of electrical connectors 48 which mate with mating electrical connectors 50 of the receptacle 46. The electrical connectors 48 and mating electrical connectors 50 may be any of several well known kinds. The master timer 22" serves as a programming unit for the plurality of slave timers 24" and may optionally serve as a battery charger for the batteries (not shown) of the plurality of slave timers 24".

Each slave timer 24" is provided with a sensory alarm device 137" (FIG. 5) and may be provided with an alarm silence switch 136".

Figure 5:
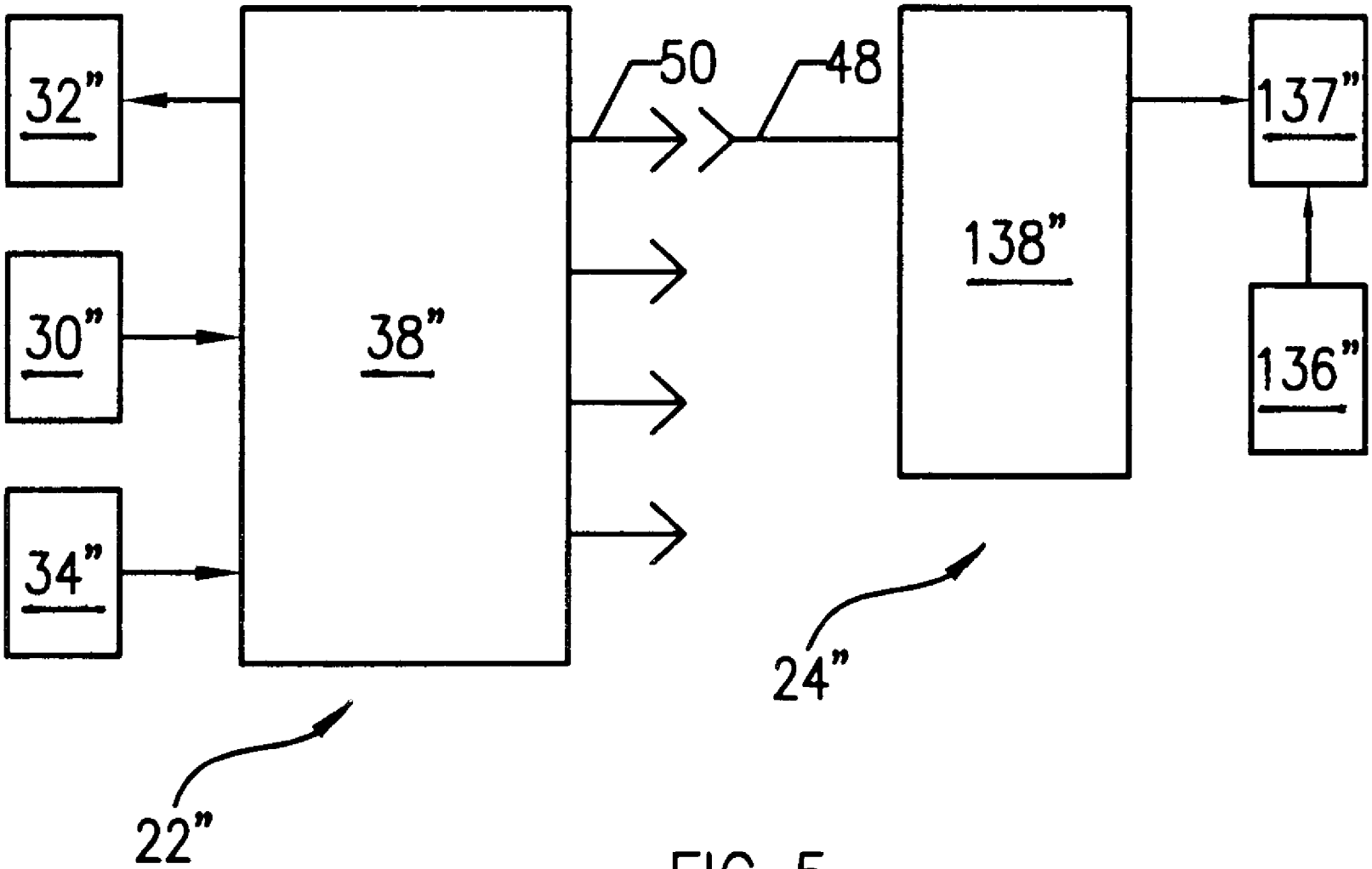
FIG. 5 is a block diagram of the timing device shown in FIG. 24.

The functionality of the alternative preferred embodiment of the present invention will be described by reference to FIG. 5. Initially the slave timers 24" are plugged into the receptacles 46 (FIG. 4) of the master timer 22" with the electrical connectors 48 engaged with the mating electrical connectors 50. When power is applied to the master timer 22" by the power switch 28" the master timing unit 38" may be programmed by use of the program input devices 30" and program input display 30". The program information entered into the master timing unit 38" is down-loaded to the slave timing units 138" through the mating electrical connectors 50 and electrical connectors 48, thereby programming the plurality of slave timers 24". Each slave timer 24" is programmed with one or more actuation points unique to the needs of the presenter to use that particular slave timer 24". To begin a coordinated presentation the timing initiation switch 34" of the master timer 22" is activated, which sends a signal through the mating electrical connectors 50 and electrical connectors to the plurality of slave timing units 138" to begin the timing sequence of each slave timer 24". The slave timers 24" may then be removed from the receptacles of the master timer 22" and worn by the individual presenters by means of the belt clips 26". Each slave timing unit 138" activates its corresponding slave sensory alarm 137" at one or more programmed activation points. The sensory alarm 137" may be turned off by means of a silence switch 136" or may turn off automatically at the end of a predetermined time period.

Figure 6:
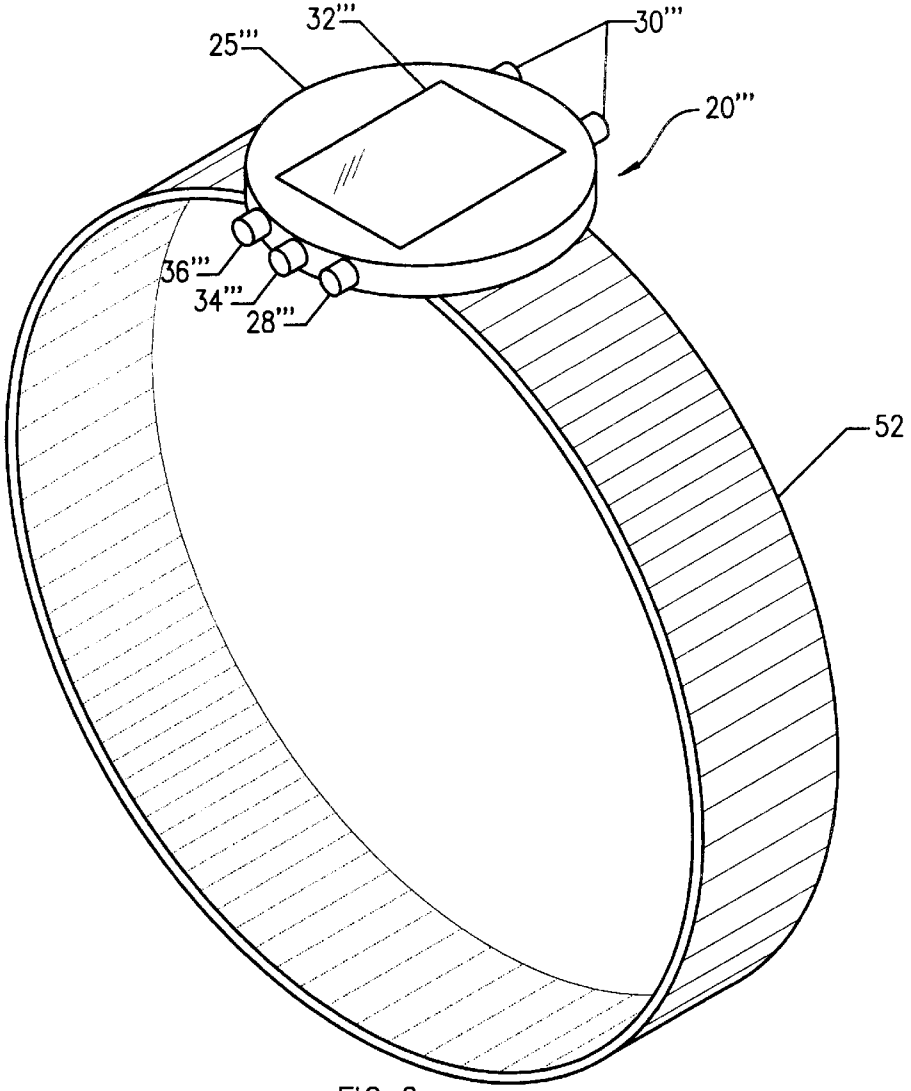
FIG. 6 is a perspective view of another alternative embodiment of a timing device for coordinating a presentation in accordance with the present invention.

FIG. 6 illustrates yet another preferred embodiment of a timing module 20'" of the present invention. In this embodiments the timing module 20'" is wrist wearable by means of a typical watch band 52 and is about the size of a typical wrist watch. The program input display 32'" is on the face of a watch-like housing 25'". The power switch 28'", program input devices 30'", initiation switch 34'" and alarm silence switch 28'" may be located around the periphery of the housing 25'".

The present invention has been described by reference to a preferred embodiment. It will be understood by those skilled in the art that the scope of the invention is not limited to the preferred embodiment, and that many variations are possible within the scope of the following claims.

What is claimed is:

1. A timing device for coordinating a presentation comprising:

a master timer comprising:

a manually activated timing initiator;

a power application switch separate from the manually activated timing initiator;

a programmable master sequencer responsive to the timing initiator;

a master sensory alarm responsive to the sequencer;

a master alarm silencer; and a communication transmitter responsive to at least one of the timing initiator and the master sequencer; wherein:

the timing initiator begins operation of the master sequencer;

the master sequencer actuates the master sensory alarm at at least one predetermined time after initiation;

the communication transmitter sends a signal at at least one of the timing initiator beginning operation of the master sequencer and a predetermined time after initiation of operation of the master sequencer; and the master sensory alarm is stopped by activation of the master sensory alarm silencer; and at least one slave timer comprising:

a communication receiver responsive to the communication transmitter of the master timer;

a slave sensory alarm operatively responsive to the communication receiver; and a slave sensory alarm silencer; wherein:

the communication receiver receives the signal from the communication transmitter and responds by operatively activating the slave sensory alarm at at least one of the time the signal is received and a predetermined time after the signal is received; and the slave sensory alarm is stopped by activation of the slave sensory alarm silencer.

2. The timing device of claim 1 wherein the slave timer further comprises:

a slave sequencer responsive to the communication receiver; and wherein:

the communication receiver responds to the signal from the communication transmitter to initiate operation of the slave sequencer; and the slave sequencer actuates the slave sensory alarm at at least one predetermined time after initiation.

3. The timing device of claim 1 wherein:

the communication receiver responds to the signal from the communication transmitter to directly activate the slave sensory alarm.

4. The timing device of claim 1 further comprising a plurality of the slave timers.

5. The timing device of claim 4 wherein:

the communication transmitter responds to the master sequencer to transmit at least a first and a second unique signals;

at least one of the plurality of slave timers is responsive to the first unique signal and unresponsive to the second unique signal; and at least another one of the plurality of slave timers is responsive to the second unique signal and unresponsive to the first unique signal.

6. The timing device of claim 5 wherein each of the slave timers further comprises:

a slave sequencer responsive to the communication receiver; and wherein:

the communication receiver responds to one of the at least a first and second unique signals from the communication transmitter to initiate operation of the slave sequencer; and the slave sequencer actuates the slave sensory alarm at at least one predetermined time after initiation.

7. The timing device of claim 5 wherein:

the communication receiver of each slave receiver responds to one of the at least a first and a second unique signal from the communication transmitter to directly activate the slave sensory alarm.

8. The timing device of claim 5 wherein each signal transmitted by the communication transmitter is a low power radio signal.

9. The timing device of claim 8 wherein each of the at least a first and a second unique signals comprises a unique transmission frequency.

10. The timing device of claim 8 wherein each of the at least a first and a second unique signals comprises a unique digital pattern.

11. The timing device of claim 1 wherein sat least one of the master sensory alarm and the slave sensory alarm is a vibratory alarm.

12. The timing device of claim 1 wherein at least one of the master sensory alarm silencer and the slave sensory alarm silencer is manually activated.

13. The timing device of claim 1 wherein at least one of the master sensory alarm silencer and the slave sensory alarm silencer is automatically activated by the passage of a predetermined period of time.

14. The timing device of claim 1 wherein at least one of the master timer and the slave timer are wearable.

15. The timing device of claim 1 wherein:

the master sensory alarm is remotely located from the master sequencer and communication transmitter; further comprising:

a master communication receiver responsive to the communication transmitter, the master sensory alarm being operatively responsive to the communication receiver.

16. A timing device for coordinating a presentation comprising:

a wearable master timer comprising:

a manually activated timing initiation push button;

a power application switch separate from the manually activated timing initiation push button;

a programmable master sequencer connected to respond to the timing initiation push button to begin a programmed timing sequence;

a master vibratory alarm connected to cause the master timer to vibrate silently at at least one programmed time after the beginning of the timing sequence;

a master alarm silencing push button connected to turn off the master vibratory alarm; and a low power radio transmitter connected to send at least one radio signal at at least one of the beginning of the programmed timing sequence and a programmed time after the beginning of the timing sequence; and at least one wearable slave timer comprising:

a low power radio receiver responsive to the low power radio transmitter of the master timer;

a slave vibratory alarm connected to vibrate silently at least in part in response to the receipt of the radio signal at at least one programmed time after the beginning of the timing sequence; and a slave alarm silencing push button connected to turn off the slave vibratory alarm.

17. The timing device of claim 16 further comprising a plurality of the wearable slave timers.

18. The timing device of claim 17 wherein:

the low power radio transmitter transmits at least a first and a second unique signals;

at least one of the plurality of slave timers is responsive to the first unique signal and unresponsive to the second unique signal; and at least another one of the plurality of slave timers is responsive to the second unique signal and unresponsive to the first unique signal.

* * * * *